US006984810B2

(12) United States Patent
Ishii

(10) Patent No.: US 6,984,810 B2
(45) Date of Patent: Jan. 10, 2006

(54) HEATER CONTROL APPARATUS AND METHOD

(75) Inventor: Kimiyasu Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 109 days.

(21) Appl. No.: 10/670,341

(22) Filed: Sep. 26, 2003

(65) Prior Publication Data

US 2004/0129694 A1 Jul. 8, 2004

(30) Foreign Application Priority Data

Sep. 30, 2002 (JP) ..... 2002-286501
Aug. 27, 2003 (JP) ..... 2003-303424

(51) Int. Cl.
*H05B 1/02* (2006.01)

(52) U.S. Cl. ..... 219/492; 219/497; 219/481; 219/501; 323/235; 323/908

(58) Field of Classification Search ..... 219/483, 219/486, 481, 492, 494, 497, 499, 501, 505, 219/508; 323/321, 908, 235, 237, 241
See application file for complete search history.

(56) References Cited

U.S. PATENT DOCUMENTS 4,809,039 A 2/1989 Ishii
5,493,485 A * 2/1996 Okado ..... 363/56.01
5,724,615 A 3/1998 Ishii
5,793,623 A * 8/1998 Kawashima et al. ..... 363/56.05
6,034,790 A * 3/2000 Kamei et al. ..... 358/475
6,507,167 B2 * 1/2003 Han et al. ..... 318/729

FOREIGN PATENT DOCUMENTS

EP 1 209 541 5/2002
JP 5-35012 2/1993
JP 2000-322137 11/2000

* cited by examiner

*Primary Examiner*—Mark Pashall
(74) *Attorney, Agent, or Firm*—Oblon, Spivak, McClelland, Maier & Neustadt, P.C.

(57) ABSTRACT

A heater control is performed without problems when a normal detection of a power source frequency cannot be performed. A heater control apparatus is configured and arranged to be operable by an alternating current having one of a plurality of frequencies. The heater control apparatus detects a zero-cross point of a voltage waveform of the alternating current to be supplied to a heater so as to generate a zero-cross signal and controls an electric power supply to the heater by using the zero-cross signal as a reference. At a time of tuning a power on, the frequency of the alternating current is tentatively determined before the frequency is detected so as to control the electric power supply to the heater based on the tentatively determined frequency, and to control the electric power supply to the heater, after the frequency of the alternating current is detected, based on the detected frequency.

20 Claims, 10 Drawing Sheets

HEATER CONTROL APPARATUS AND METHOD

BACKGROUND OF THE INVENTION

1. Field of the Invention

The present invention generally relates to a technique for controlling an electric heater and, more particularly, to a heater control apparatus and method for controlling an electric heater provided in a fixation apparatus of an image forming apparatus such as a copy machine or a printer using an electrophotography method.

2. Description of the Related Art

An image forming apparatus using an electrophotography method, such as a copy machine or a printer, comprises: an image forming part which includes a photosensitive material and a electric charger part, an exposure part, a developer part, a transfer part, etc., provided around the photosensitive material; and a fixation device which fixes a toner image transferred onto a transfer paper by the transfer part. The fixation device is provided with a fixation roller having an electric heater therein. In order to keep the temperature of the fixation roller constant, also provided is a heater control device which controls electric supply to the heater.

Such kind of a heater control device is, disclosed in Japanese Laid-Open Patent, Application No. 2000-322137. The heater control device disclosed in this patent document comprises: a triac which turns on and off electric supply from a commercial power source to a heater; and a trigger means which turns on the triac at a predetermined timing with reference to a zero-cross signal output from a zero-cross detection circuit when a voltage of the alternating current of the commercial power source becomes 0 volt. The trigger means outputs a trigger signal at a predetermined timing (phase angle) on the basis of the above-mentioned zero-cross signal, and turns on the triac by the trigger signal. The triac maintains an on state until a subsequent zero-cross signal is output. Therefore, the conduction angle in a half cycle of the alternating current varies according to the timing of generation of the trigger signal. Thereby, an effective value of the alternating current (AC) voltage applied to the heater can be changed, and the electric power supplied to the heater can be controlled.

Since the power supply to the heater is controlled by a phase control of a conduction angle of the switching means such as a triac in the above-mentioned heater control device, information regarding power source frequency such as a zero-cross signal. However in Japan, for example, there are areas where the frequency of the alternating current of the commercial power source is either 50 Hz or 60 Hz. Even in such a case, it is desirable that the same apparatus can be used in either area regardless of the frequencies. For this reason, it is necessary to detect automatically the frequency of the alternating current supplied by the power source accurately, so as to determine the timing of turning on the triac within each half cycle in response to the frequency of the alternating current to generate the trigger signal and perform a phase control of the triac. Therefore, a power supply control for the heater cannot by started until the detection of the zero-cross signal is completed.

Additionally, the waveform of a power source voltage is not always a complete sinusoidal wave. That is, the waveform of a power source voltage may be distorted in a case where, for example, a machine consuming a large electric power is operated in a plant or the like located in the vicinity or a private power generation facility is used. Accordingly, the zero-cross signal is disturbed by the distortion of the waveform, which may prevent an accurate frequency detection. In such a case, the above-mentioned power supply control of the heater cannot be performed, which results in a detection of an abnormal condition and a display of an error display. Thus, the image forming apparatus may be set in an inoperative state.

Thus, in the technique disclosed in the above-mentioned patent document, a first trigger generating means and a second trigger generating means are provided, the first trigger generating means for generating a trigger signal in synchronization with the zero-cross signal and the second trigger generating means for generating a trigger signal in a synchronization with the zero-cross signal. The first trigger generating means is operated when a zero-cross signal of an alternating current supplied by a commercial power source is detectable, while the second trigger generating means is operated when the zero-cross signal is not detectable. Thereby, even when it is not possible to detect a zero-cross signal, electric power supplied to an object to be controlled such as a heater of a fixation device can be controlled.

However, the above-mentioned technique requires an increase in the manufacturing cost of the image forming apparatus since two kinds of trigger generating means are needed. In addition, an electric power control cannot be started until it is known as to whether a zero-cross signal is detectable by the zero-cross signal detecting means. Additionally, there is a problem in that an accurate control responsive to the power source frequency cannot be performed since the electric power supplied to the heater is controlled by performing a phase control of a triac using a trigger signal which is asynchronous to the zero-cross signal when it becomes impossible to detect the zero-cross signal.

Recently, a start-up time of fixation has been considered to be important as a specification when controlling a heater of a fixation device provided in an image forming apparatus. Therefore, even a time for detecting a power source frequency cannot be disregarded, and it is desirous to reduce such a time for detecting a power source frequency.

SUMMARY OF THE INVENTION

It is a general object of the present invention to provide an improved and useful heater control apparatus and method in which the above-mentioned problems are eliminated.

A more specific object of the present invention is to achieve a predetermined heater control within a short time after a power is turned on.

Another object of the present invention is to provide a heater control without problems when a normal detection of a power source frequency cannot be performed.

A further object of the present invention is to reduce a rising time of a fixation process in an image forming apparatus so as to reduce a down time of the apparatus.

In order to achieve the above-mentioned objects, there is provided according to one aspect of the present invention a heater control apparatus configured and arranged to be operable by an alternating current having one of a plurality of frequencies, and detecting a zero-cross point of a voltage waveform of the alternating current to be supplied to a heater so as to generate a zero-cross signal and controlling an electric power supply to the heater by using the zero-cross signal as a reference, wherein, at a time of tuning a power on, the frequency of the alternating current is tentatively determined before the frequency is detected so as to control the electric power supply to the heater based on the tentatively determined frequency, and to control the electric power supply to the heater, after the frequency of the alternating current is detected, based on the detected frequency.

In the heater control apparatus according to the present invention, the tentatively determined frequency may be a highest frequency from among the plurality of frequencies. Additionally, the plurality of frequencies may be 50 Hz and 60 Hz, and the tentatively determined frequency may be 60 Hz.

The heater control apparatus according to the present invention may comprise: a zero-cross detection circuit which detects a zero-cross point of the voltage of the alternating current which is supplied to the heater from an alternating current power source part which accepts an alternating current of either 50 Hz or 60 Hz; a switching circuit which turns on and off the electric power supply to the heater; and a control part which controls the on and off the switching circuit at a predetermined timing based on the zero-cross signal output from the zero-cross detection circuit, wherein the control part includes a setting circuit for setting a phase angle timer which determines a timing of turning on the switching circuit, and a frequency detection circuit which detects the frequency of the alternating current supplied to the alternating current power source part from the zero-cross signal of the zero-cross point of the voltage of the alternating current by the zero-cross detection circuit generated by the zero-cross detection circuit; at the time of turning a power on, the electric power supply to the heater is controlled by setting a timer value of the phase angle timer in accordance with the tentatively determined frequency; and the electric power supply to the heater is controlled, after the frequency of the alternating current is detected by the frequency detection circuit, by setting the timer value of the phase angle timer in accordance with the detected frequency.

In the heater control apparatus, the control part may continue the control of the electric power supply to the heater by setting the timer value of the phase angle timer based on the tentatively determined frequency when the frequency detected by the frequency detection circuit does not match any one of the plurality of frequencies. Additionally, the control part may store information in a nonvolatile memory, the information indicating that the frequency detected by the frequency detection circuit does not match any one of the plurality of frequencies and the electric power supply to the heater is continued by setting the timer value of the phase angle timer based on the tentatively determined frequency.

There is provided according to another aspect of the present invention an image forming apparatus comprising: one of the heater control apparatuses according to the present invention; and a fixation device equipped with the heater.

Additionally, there is provided according another aspect of the present invention a heater control method of a heater configured and arranged to be operable by an alternating current having one of a plurality of frequencies, the heater control method detecting a zero-cross point of a voltage waveform of the alternating current to be supplied to a heater so as to generate a zero-cross signal and controlling an electric power supply to the heater by using the zero-cross signal as a reference, the heater control method comprising the steps of: tentatively determining, at a time of tuning a power on, the frequency of the alternating current before the frequency is detected; controlling the electric power supply to the heater based on the tentatively determined frequency; and controlling the electric power supply to the heater, after the frequency of the alternating current is detected, based on the detected frequency.

In the heater control method according to the present invention, a highest frequency from among the plurality of frequencies may be selected as the tentatively determined frequency in the step of tentatively determining the frequency. Additionally, the plurality of frequencies may be 50 Hz and 60 Hz, and 60 Hz may be selected as the tentatively determined frequency.

In the heater control method according to the present invention, the electric power supply to the heater may be controlled, at the time of turning a power on, by setting a timer value of a phase angle timer in accordance with the tentatively determined frequency, the phase angle timer determining a timing of turning, on a switching circuit; and the electric power supply to the heater may be controlled, after the frequency of the alternating current is detected, by setting the timer value of the phase angle timer in accordance with the detected frequency.

The heater control method may further comprise a step of continuing the control of the electric power supply to the heater by setting the timer value of the phase angle timer based on the tentatively determined frequency when the detected frequency does not match any one of the plurality of frequencies. Additionally, the heater control method may further comprise a step of storing information in a nonvolatile memory, the information indicating that the frequency detected by the frequency detection circuit does not match any one of the plurality of frequencies and the electric power supply to the heater is continued by setting the timer value of the phase angle timer based on the tentatively determined frequency.

According to the heater control apparatus and heater control method of the present invention, since the phase control of an alternating current is started based on the tentatively determined frequency which is tentatively determined before the power source frequency is detected, the rising time of the heater is reduced, thereby achieving the heater control within a short time after a power is turned on. Moreover, since the phase control is performed based on the actually detected power source frequency after the detection of the power source frequency is completed, the control accuracy of the heater is further improved. Furthermore, even when the detection of the power source frequency cannot be completed normally, the phase control of the heater can be continued based on the tentatively determined frequency.

According to the image formation apparatus in which the electric power supply to the fixation heater of the fixation device is controlled by the heater control apparatus of the present invention, the rising time after a power is turned on is shortened, which reduces a waiting time. Moreover, since the apparatus is prevented from being stopped due to an error even when the power source frequency is not detected, a downtime of the image forming apparatus can be reduced.

Other objects, features and advantages of the present invention will become more apparent from the following detailed description when read in conjunction with the accompanying drawings.

DETAILED DESCRIPTION OF THE PREFERRED EMBODIMENT

A description will be given below of an embodiment of the present invention with reference to the drawings.

Figure 1:
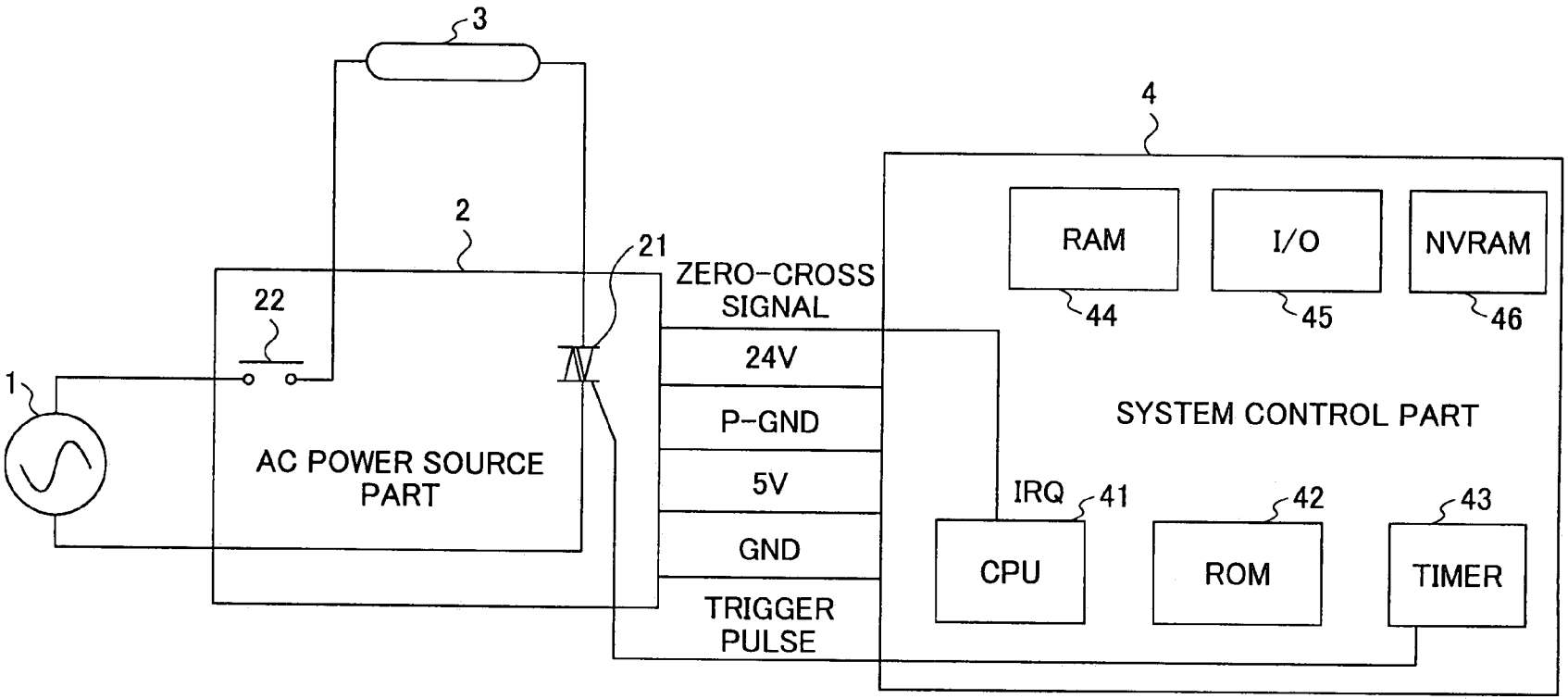
FIG. 1 is a block diagram of apart of an image forming apparatus which relates to a heater control apparatus according to an embodiment of the present invention.

FIG. 1 is a block diagram showing a part of an image forming apparatus using an electrophotography method, which relates to a heater control apparatus according to an embodiment of the present invention.

The heater control apparatus shown in FIG. 1 comprises an alternating current (AC) power source part 2 and a system control part 4. The AC power source part 2 is supplied with an alternating current of 50 Hz or 60 Hz from a commercial power source 1, and supplied the alternating current to a fixation heater 3, which is a heater such as a halogen heater, provided in a fixation roller of a fixation device so as to cause the fixation heater to generate heat. An electric power supply circuit of the heater control apparatus is provided with a breaker contact 22 for over-current protection and a triac 21 as a switching means that are connected to the fixation heater 3 in series.

The AC power source part 2 is also provided with a direct current generating circuit (not shown in the figure) and a zero-cross detection circuit (described later). The direct current generating circuit changes the voltage of the alternating current supplied by the commercial power source 1 and rectifies and smoothes the alternating current so as to generate direct currents of 24 V and 5 V to be supplied to the system control part 4 and direct-current loads of the image forming apparatus.

The system control part 4 comprises of a CPU 41, a ROM 42, a timer 43, a RAM 44, an input-and-output circuit (I/O) 45 and a non-volatile memory (NVRAM) 46, etc., which are connected to each other through a system bus (not shown in the figure). The CPU 41 controls the triac 21 of the AC power source part 2 according to a phase control by a trigger pulse by using programs and parameters stored in the ROM 42 so as to control the electric power supply to the fixation heater 3. Additionally, the CPU 41 has functions to generally control the entire image forming apparatus such as a conveyance control of transfer papers and a sequence control of a photosensitive material and each part relating to electric charge, exposure, development and transfer.

Hereinafter, a description will be given of the function as a control means concerning the control of the fixing heater 3.

Figure 2:
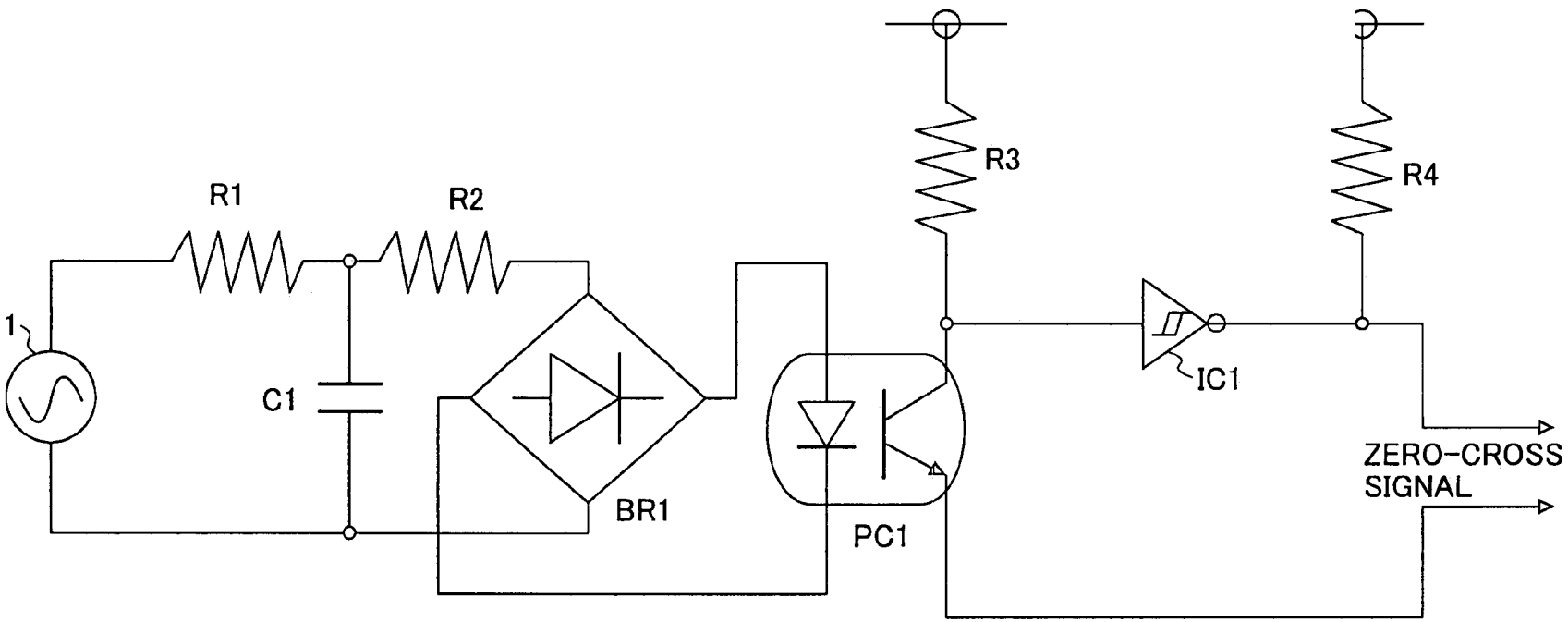
FIG. 2 is a circuit diagram of a zero-cross detection circuit provided in an AC power source shown in FIG. 1.

FIG. 2 shows an example of the zero-cross detection circuit, which is provided in the AC power source part 2. The zero-cross detection circuit carries out full wave rectification of the alternating current supplied from the commercial power source 1 by a diode bridge BR1 via a circuit comprising a low-pass filter, a capacitor C1 and resistors R1 and R2 which provide a current limiting function. The full rectified pulsating signal transmitted in an insulating manner by a photo-coupler PC1 comprising a light-emitting diode (LED) and a photo-transistor (PT), and supplied to a hysteresis inverter IC1 so as to generate a zero-cross signal. Resistors R3 and R4 are pull-up resistors for applying a positive voltage.

Figure 3:
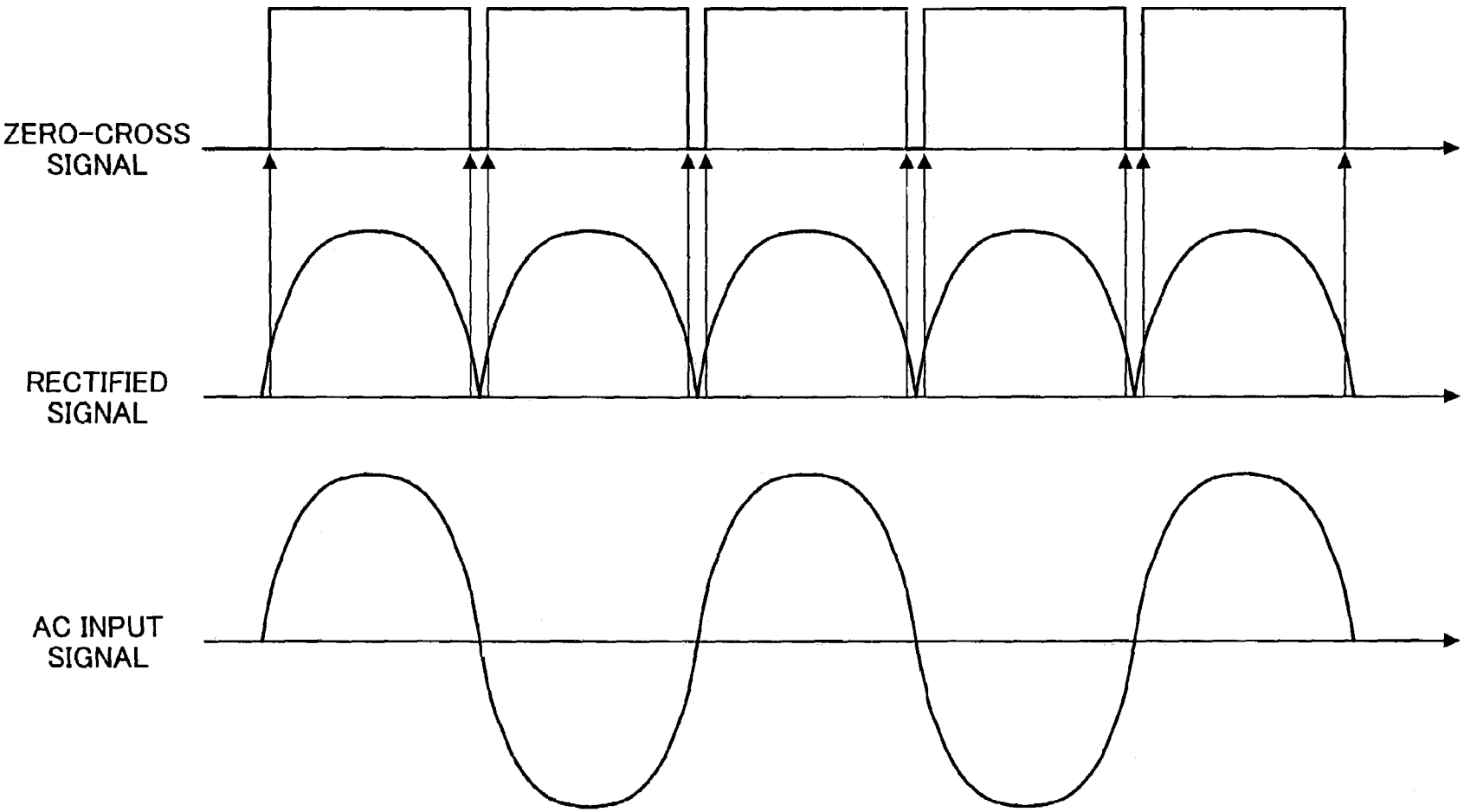
FIG. 3 is a waveform chart of an AC input signal of an alternating current supplied by an AC power source, a rectified signal of the AC input signal and a zero-cross signal.

If the waveform of an "AC input signal" according to the alternating current supplied from the commercial power source 1 is a complete waveform having no noise and dip as shown in FIG. 3, the waveform of each of a "rectified signal" obtained by full-wave rectification of the "AC input signal" and a "zero-cross signal" obtained by shaping the rectified-signal" into a square wave by the hysteresis inverter IC1 is an accurate waveform.

The zero-cross signal detected (or generated) in the zero-cross-detection circuit is supplied to an interruption terminal IRQ of the CPU 41 of the system control part 4 from the AC power source part 2 shown in FIG. 1. Then, the CPU 41 is set in an interruption operation mode so as to cause an interruption occurring at a falling edge of the zero-cross signal. Thereby, an interruption occurs immediately before the AC input signal turns to zero from a positive or negative voltage. By counting a number of times of the interruption (hereinafter, referred to as a zero-cross interruption) during a predetermined time period which is previously set, the frequency of the supplied alternating current (hereinafter, referred to as a power source voltage) can be detected.

According to the present invention, the power source frequency is temporarily determined to be a predetermined frequency such as, for example, 60 Hz so as to start the control of electric power supply to the fixation heater 3 by a phase control of the triac 21 prior to the actual detection of the power source frequency. That is, on the assumption that the power source frequency is 60 Hz, the control of electric power supply to the fixation heater 3 is performed by a phase control of the triac 21 prior to the actual detection of the power source frequency by setting a timer value of a phase angle timer (mentioned later) which is for controlling the triac 21 of the AC power source part 2. The timer value corresponds to a time period from a zero-crossing time to a time at which a trigger pulse for activating the triac 21 is generated.

On the other hand, when detection of the power source frequency is started with the above-mentioned predetermined time period being set to 500 ms, the number of times of zero-cross interruption until is counted until 500 ms is passed. If the count number of zero-cross interruption is 45 to 54, it is determined that the power source frequency is 50 Hz. If the count number of zero-cross interruption is 55 64, it is determined that the power source frequency is 60 Hz. When it is determined that the power source frequency is 50 Hz, the setting data of the timer value of the phase angle timer for performing the phase control of the triac 21 is changed to data for 50 Hz. However, when the count number of zero-cross interruption is a number in a range other than the above-mentioned ranges, that is, when the count number is smaller than 45 or equal to or greater than 65, the correct power source frequency cannot by detected. In such a case, the phase control of the triac 21 is continued on the assumption that the power source frequency is 60 Hz, which was determined temporarily, so as to continue the control of electric power supply to the fixation heater 3. In the meantime, an effective voltage applied to the fixation heater 3 differs from a case where the power source voltage is 50 Hz to a case where the power source voltage is 60 Hz even if the triac 21 is activated after the same time period has passed from the zero-crossing point since a half of a period of the alternating current differs from 50 Hz to 60 Hz.

Figure 4:
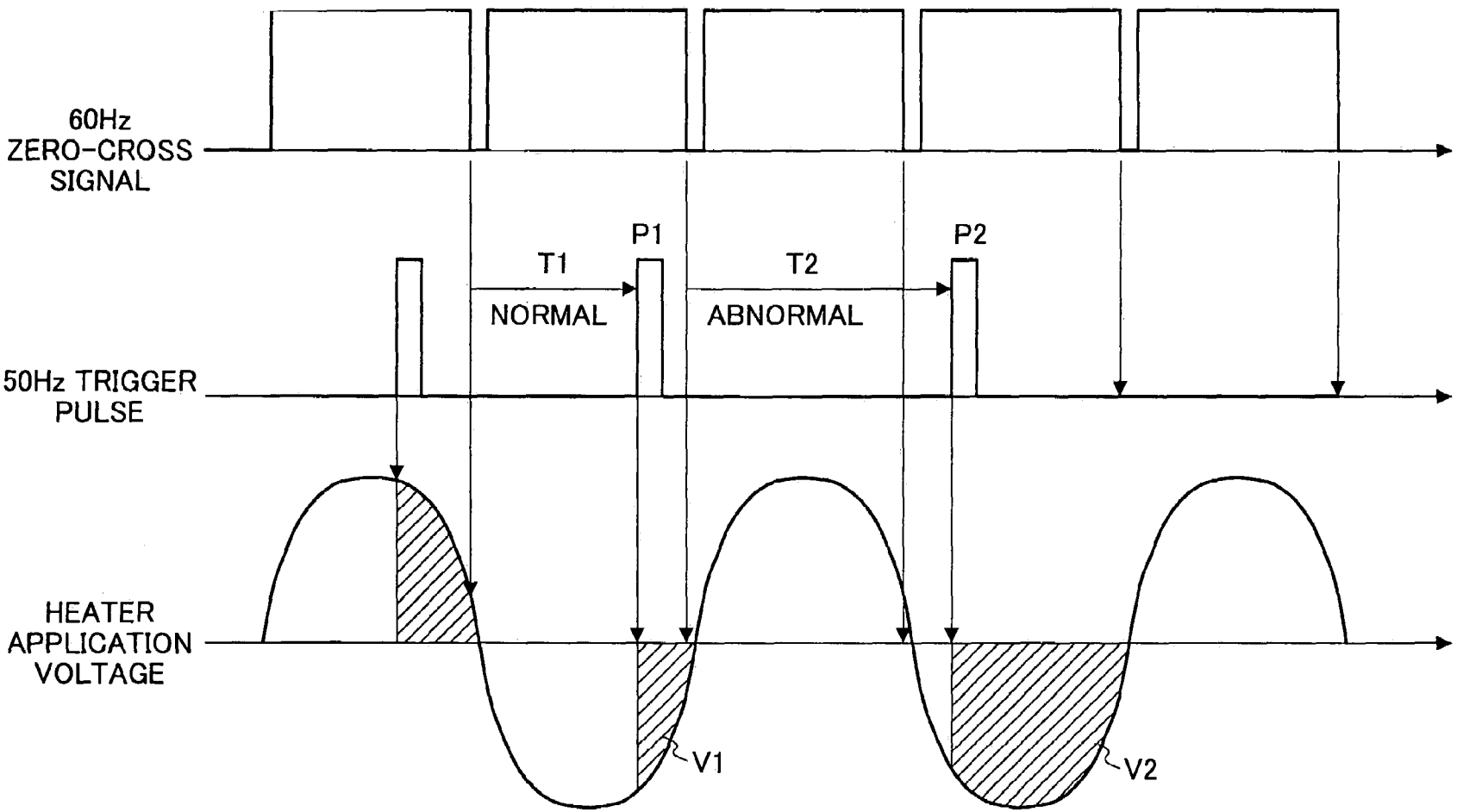
FIG. 4 is a waveform chart for explaining a problem which arises when a phase control of a triac is performed using a 50 Hz trigger pulse when a power source frequency is 60 Hz.

For example, as shown in FIG. 4, if a voltage applied to the fixation heater 3 is controlled by phase-controlling the triac 21 by the trigger pulse for 50 Hz when the power source frequency is 60 Hz and the zero-cross signal is generated based on 60 Hz, the effective voltage V1 can be normally controlled if the trigger pulse is generated, as indicated by P1, at the timer value T1 within a half period of the alternating current of 60 Hz from a zero-cross point. However, supposing if the timer value T2, which is a minimum effective voltage for 50 Hz, is set to the phase angle timer, a trigger pulse P2 is generated at a point which is after the subsequent zero-cross point (a half period of the alternating current of 60 Hz) as shown in FIG. 4, which results in a large effective voltage V2 being applied to the fixation heater 3. This causes a condition where a normal phase control cannot be performed (abnormal).

The above-mentioned inconvenience can be eliminated by performing a phase control by setting the timer value of the phase angle timer by assuming that the power source frequency is 60 Hz until an actual power source frequency is detected. However, when the actual power source voltage is 50 Hz and if the triac 21 is turned on by generating a trigger pulse at the same timing (timer value) as a case of 60 Hz, the effective voltage applied to the fixation heater 3 is larger than that of an alternating current of 60 Hz, the effective voltage being larger than the realizable minimum voltage. Therefore, attention must be given to the following points.

First, a consideration will be given of a case of an initial period of electric power supply to the fixation heater 3. The object of performing a phase control of an alternating current supplied to the fixation heater 3 in the initial power supply period is to reduce an inrush current flowing into the fixation heater 3 so as to prevent the switching element such as the triac 21 from being damaged by performing a soft start which gradually increases the effective voltage applied to the fixation heater 3 from the minimum effective voltage. However, if the phase control at the initial power supply period is performed with a phase angle, at which the minimum effective voltage is set fork an alternating current of 60 Hz, being applied to an alternating current of 50 Hz, the initial minimum effective voltage is increased by about 20 V. In such a case, it is possible not to increase an inrush current by changing a waveform pattern of the voltage applied to the fixation heater 3 when performing a soft start. Therefore, even if the phase control of the alternating current supplied to the fixation heater 3 is performed on the assumption that the power source frequency is 60 Hz, the inrush current can be such a degree that it is within an absorbable range.

Moreover, although a purpose of the phase control of the alternating current supplied to the fixation heater 3 during a normal power supply is to improve accuracy in controlling a fixation temperature, a more important purpose for the present is to reduce a flicker noise given to other loads connected to the same power source. The flicker noise refers to a phenomenon that an on/off of the power supply to the fixation heater 3, which consumes a large electric power, causes a voltage fluctuation of the commercial power source 1, which sequentially causes flickering of an electric light or a fluctuation in a TV screen, etc. In order to prevent such a phenomenon, it is effective to perform a soft start the same as the soft start at the initial time of power supply.

However, unlike the inrush-current prevention at the initial time of power supply, in consideration of the control of a fixation temperature, there is not such a degree of freedom in the voltage pattern applied to the heater to perform a soft start as in the initial power supply time. For this reason, it is desirable to perform a control according to a voltage pattern matching an actual power source frequency. In the present embodiment, while performing the phase control by setting the timer value of the phase angle timer based on the tentatively determined power source frequency, the detection of the power source frequency is continuously performed. Then, when an actual power source frequency is detected, the timer value of the phase angle timer is set based on the detected power source frequency, and the phase control is continued with the timer value based on the actual power source frequency.

However, even when the phase control is continued based on the tentatively determined frequency (hereinafter, may be referred to as a tentative frequency), there may be a case in which a difference is seen in that the flicker noise is slightly increased while there is no substantial change in the characteristics of the temperature control. Such a slight increase in the flicker noise is not such a problem that requires to stop an operation of the image forming apparatus. Accordingly, in the heater control apparatus according to the present invention, the image forming apparatus is not stopped due to an error in the detection of the power source frequency as in the conventional apparatus even when the detection of the power source frequency is not performed normally, and the phase control can be continued based on the tentative frequency (preferably 60 Hz) without substantial problems. Consequently, the downtime of the image formation apparatus can be reduced.

When the phase control is continued based on the tentative frequency even when there occurs an error in the detection of the power source frequency, it is preferable to store information indicating the occurrence of the error in a memory. Specifically, the information indicating the occurrence of the error in the detection of the power source frequency is accumulated in the NVRAM 46 of the system control part shown in FIG. 1 together with date and time information. The information accumulated in the NVRAM 46 is used by an operator when performing a maintenance inspection to check a present operating condition or a past operating condition of the image forming apparatus. Therefore, if the information indicating the occurrence of an error in the detection of the power source frequency is accumulated in the NVRAM 46, a maintenance worker is able to recognize that the apparatus has been operated based on the tentative frequency (60 Hz) due to the error in the detection of the power source frequency.

A description will now be given, with reference to FIGS. 5 through 9, of a fixation heater control performed by the system control part 4 (mainly, the CPU 41) shown in FIG. 1.

Figure 5:
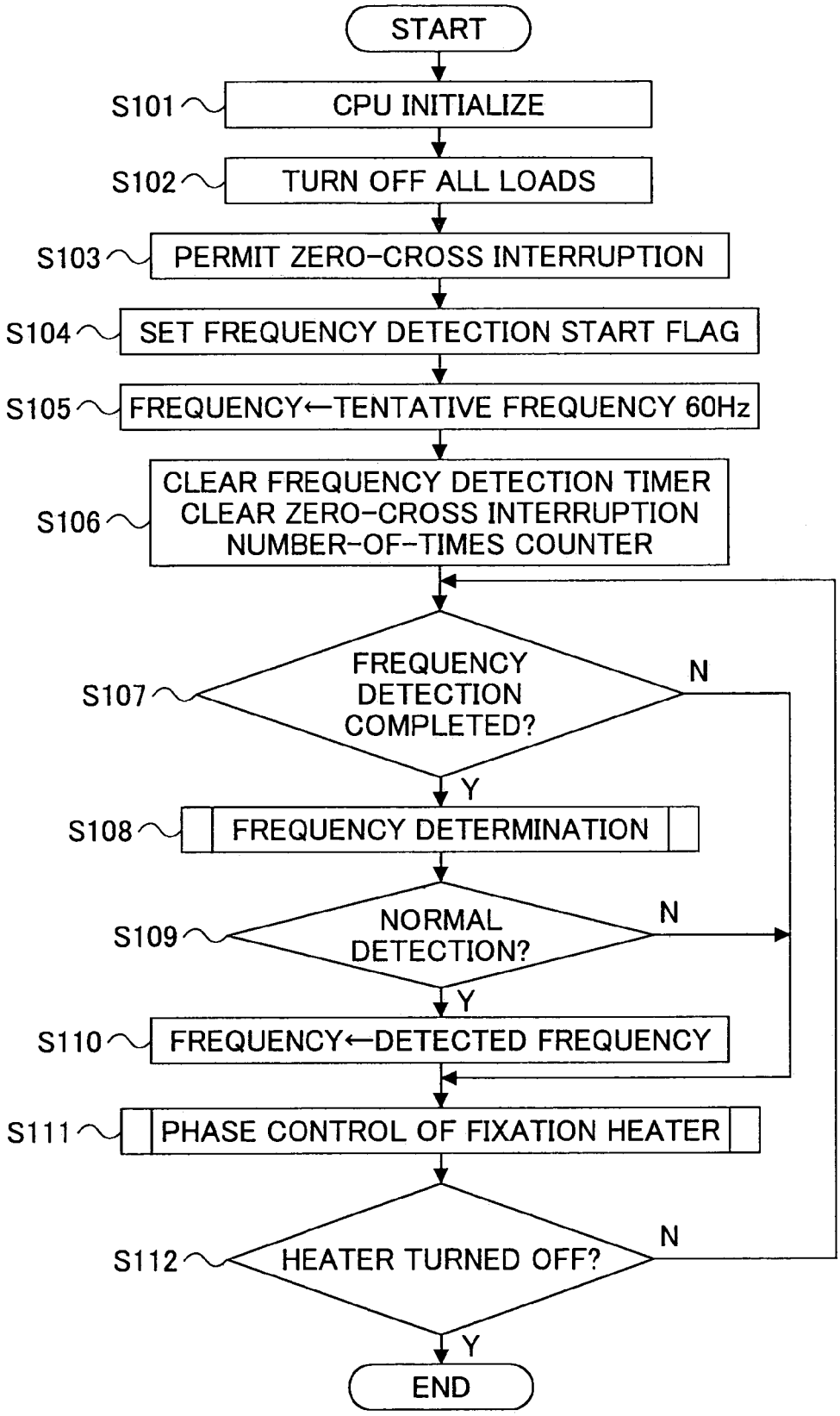
FIG. 5 is a flowchart of a main routine of a fixation heater control process performed by a system control part shown in FIG. 1.
Figure 6:
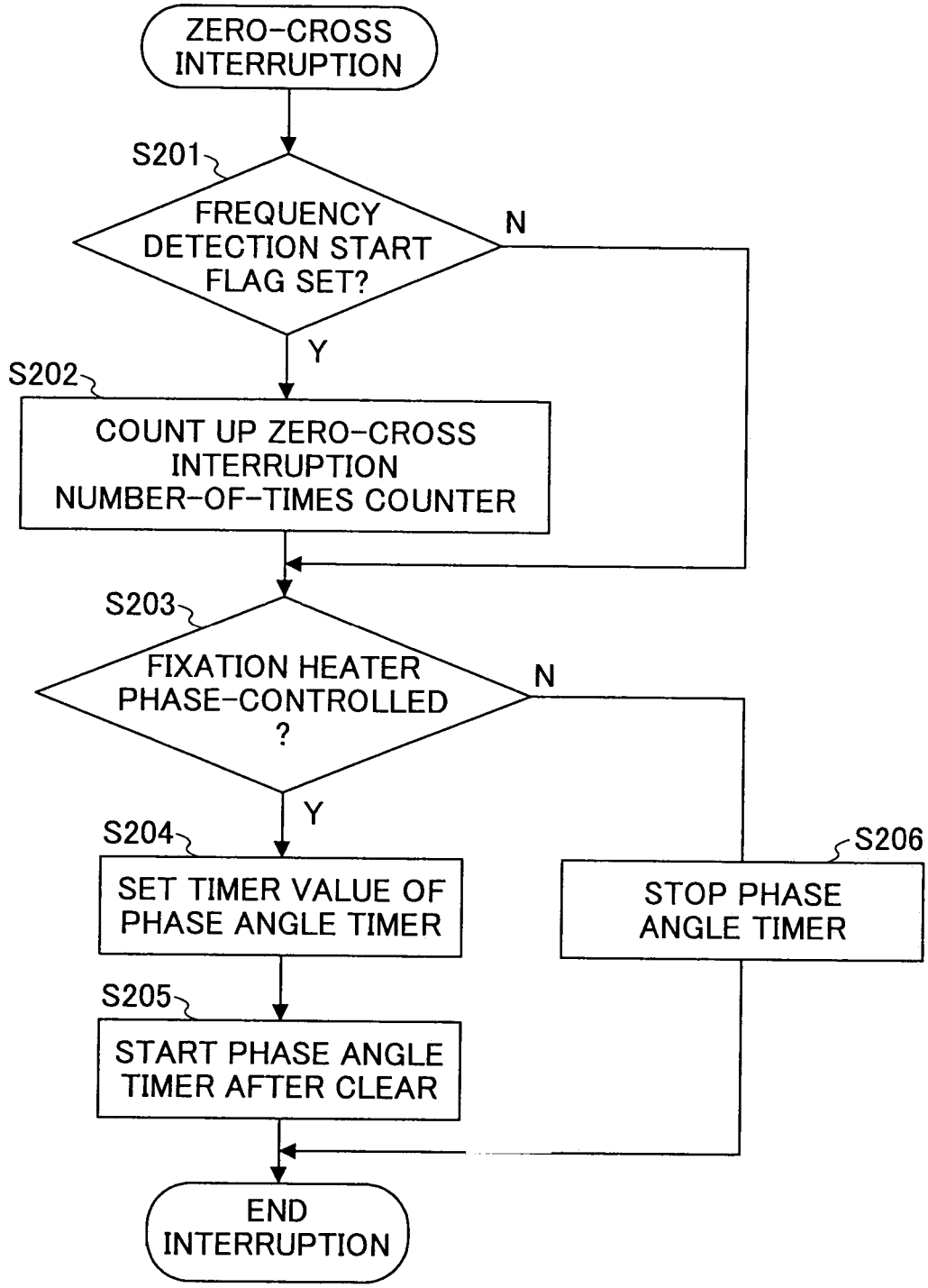
FIG. 6 is a flowchart of a zero-cross interruption process.
Figure 7:
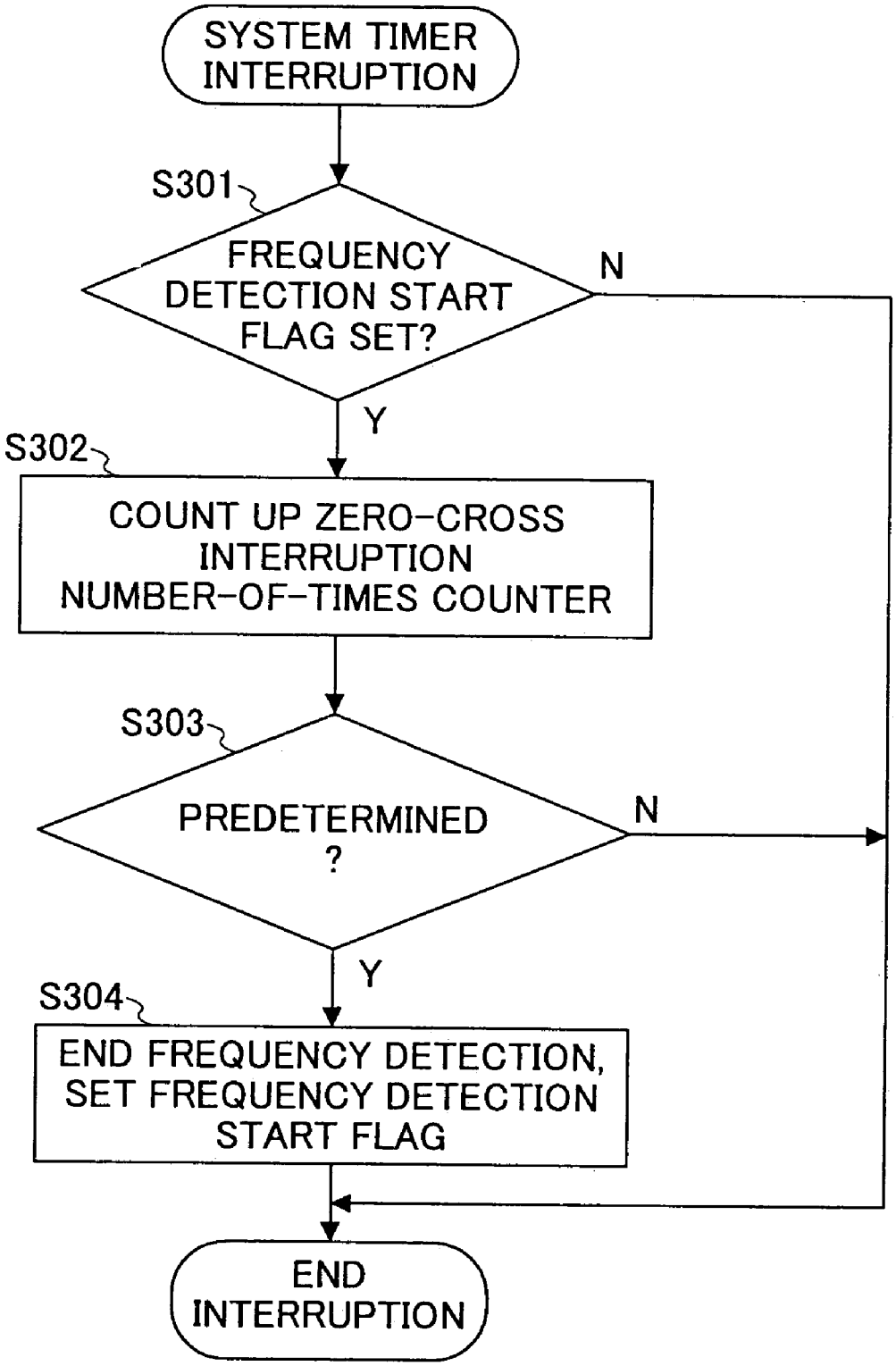
FIG. 7 is a flowchart of a system timer interruption process.
Figure 8:
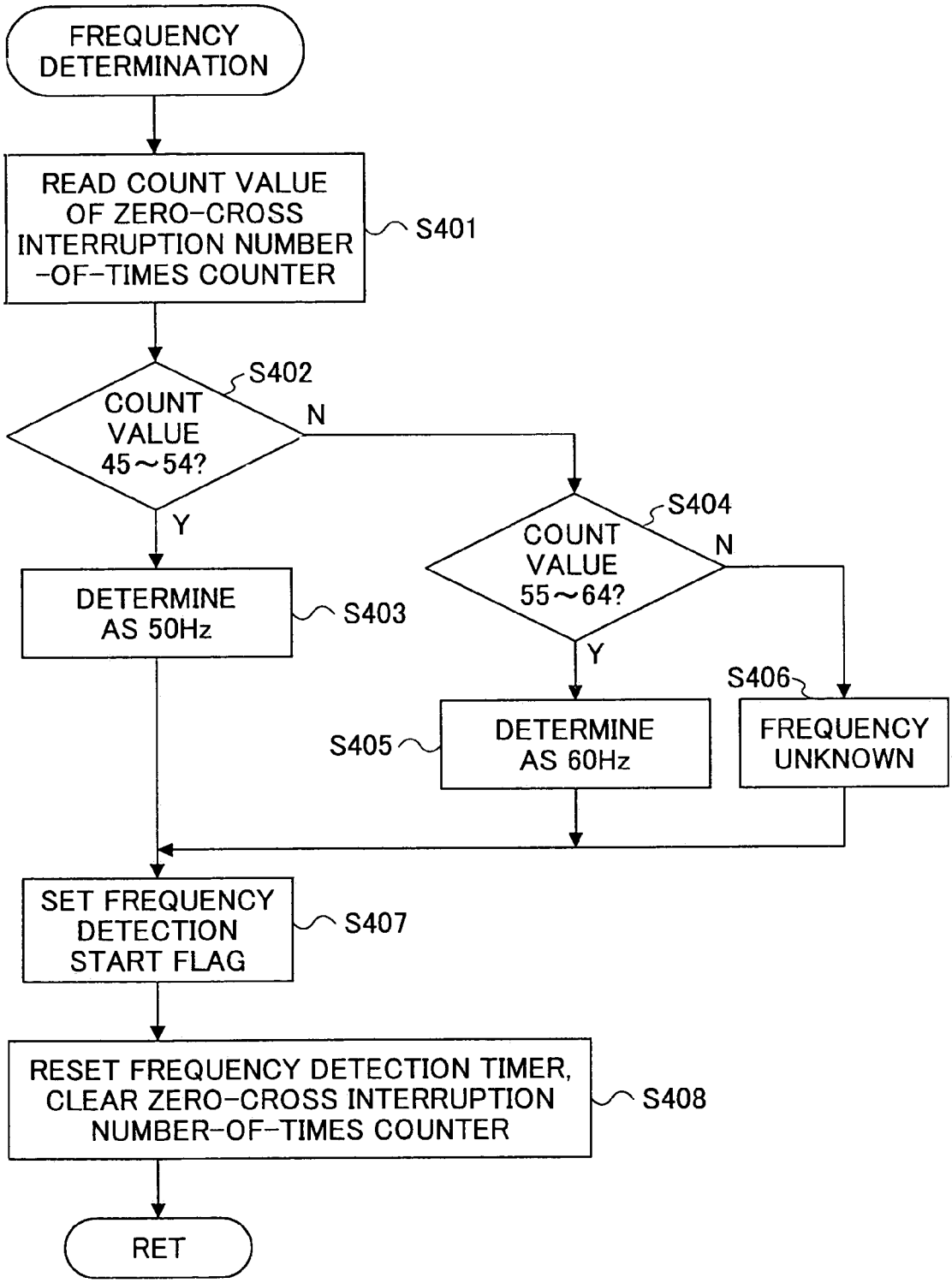
FIG. 8 is a flowchart of a subroutine process of a frequency determination in the main routine shown in FIG. 5.
Figure 9:
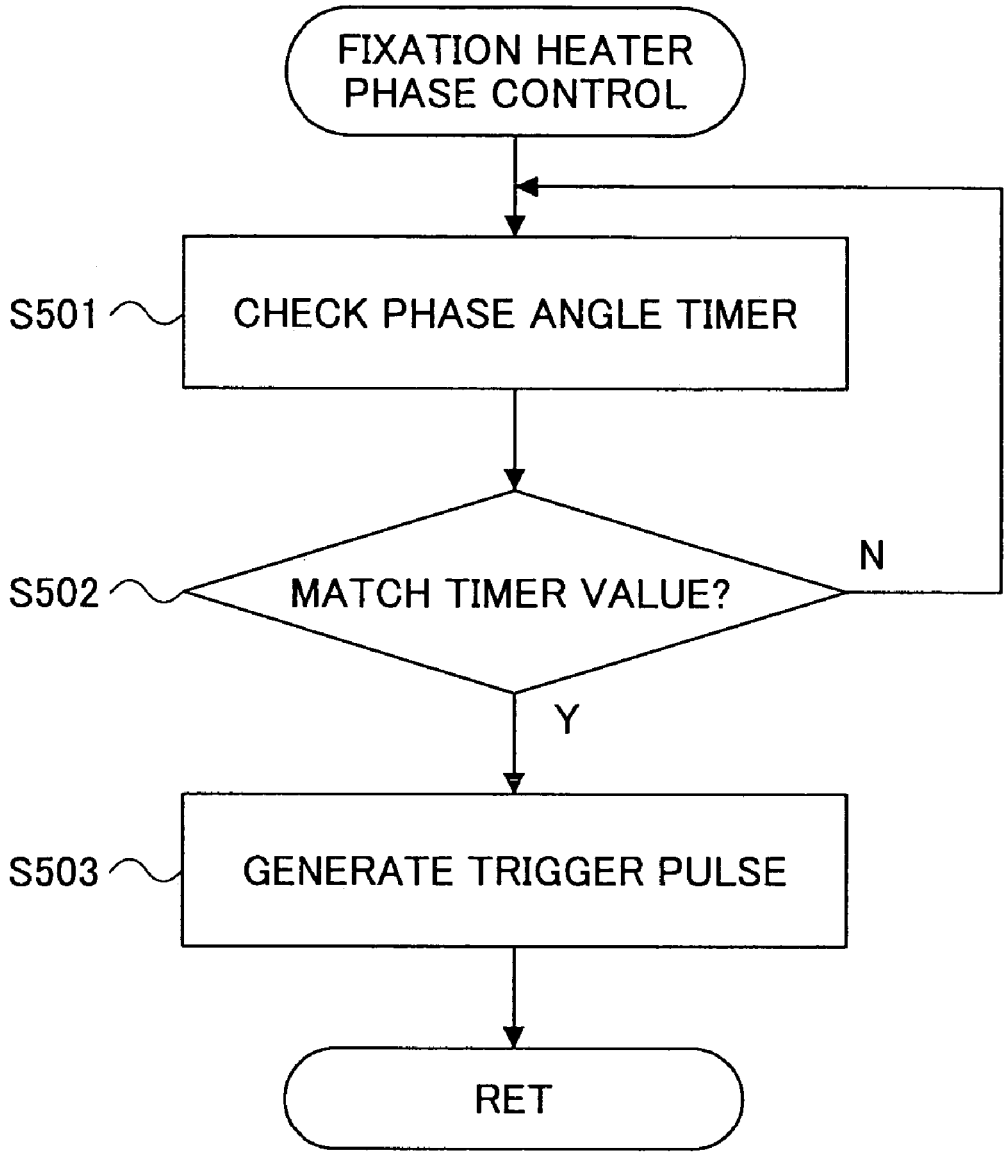
FIG. 9 is a flowchart of a subroutine process of a phase control of a fixation heater in the main routine shown in FIG. 5.

FIG. 5 shows a flowchart of a main routine of a fixation heater control process. FIG. 6 shows a flowchart of a zero-cross interruption process. FIG. 7 shows a flowchart of a system timer interruption process. FIG. 8 shows a flowchart of a subroutine of a frequency determination process shown in FIG. 5. FIG. 9 is a flowchart of a subroutine of a fixation heater phase control process shown in FIG. 5. In FIG. 5 through FIG. 9, "step" is abbreviated as "S".

When a power is turned on in the image forming apparatus shown in FIG. 1, the CPU 41 of the system control part 4 starts processing of the main routine shown in FIG. 5. Then, first in step 101, various settings (CPU initialization) of the CPU 41 are performed. In step 102, all loads are turned off so as to prepare for subsequent control so as to prevent erroneous operations of the loads. In the CPU initialization in step 101, a permission of a system timer interruption with respect to a setting system timer of various timers (including the timer 43 shown in FIG. 1) is performed.

Then, in step 103, a zero-cross interruption is permitted, in step 103, so as to perform a detection of a power source frequency (power source frequency detection). Then, a power source frequency detection start flag is set in step 104, and a tentative frequency of 60 Hz is set, in step 105, as the power source frequency, and the tentative frequency is stored in a memory. Subsequently, in step 106, a frequency detection timer and a counter of a number of zero-cross interruptions are cleared to zero.

Then, it is determined, in step 107, whether or not the frequency detection is completed. If the frequency detection is not completed, the routine proceeds to step 111 so as to perform a fixation heater control (mentioned later with reference to FIG. 9) based on the tentatively determined power source frequency of 60 Hz. On the other hand, if it is determined, in step 107, that the frequency detection is completed, the routine proceeds to step 108 so as to perform a frequency determination process (mentioned later with reference to FIG. 8).

Then, it is determined, in step 109, whether or not the power source frequency has been detected normally. If it is determined, in step 109, that the power source frequency has been detected normally, the routine proceeds to step 110. In step 110, the detected frequency is set as the power source frequency. Then, the fixation heater control is performed, in step 111, based on the detected power supply frequency. On the other hand, if it is determined, in step 109, that the frequency has not been detected normally, the routine proceeds to step 111 so as to continue the fixation heater control based on the tentative power source frequency. Thereafter, it is determined, in step 112, whether or not the fixation heater 3 is turned off. If it is determined that the fixation heater 3 is turned off, the routine is ended. Otherwise, the routine returns to step 107 so as to repeat the above-mentioned process.

On the other hand, a zero-cross signal is supplied from the alternating current power source 2 shown in FIG. 1 to the interruption terminal IRQ of the CPU 41 so that a zero-cross interruption process shown in FIG. 6 is performed at each falling edge of the zero-cross signal. Then, it is determined, in step 201, whether or not the frequency detection start flag is set. If the flag is not set, the routine proceeds to step 203 without any processing. However, since the frequency detection start flag is set in step 104 of FIG. 5, the flag is maintained without change until it is reset. Therefore, the routine proceeds to step 202 so as to count up (+1) a zero-cross interruption counter by a memory provided in the RAM 44.

Then, it determined, in step 203, whether or not the fixation heater phase control is being performed. If the fixation heater phase control of step 111 of FIG. 5 is being performed, the determination of step 203 is affirmative "YES", and routine proceeds to step 204. In step 204, the timer value (a time period from a zero-crossing time to a time of generation of a trigger pulse) of an internal phase-angle timer is set. Then, a phase angle timer is cleared in step 205 so as to start a time measurement, and the interruption process is ended. On the other hand, if the fixation heater phase control is not being performed, the phase angle timer is stopped in step 206, and the interruption process is ended.

Moreover, a system timer interruption process shown in FIG. 7 is performed each time a system clock generated by an oscillation circuit in the system control part 4 shown in FIG. 1 is supplied. In this interruption process, it is determined first, in step 301, whether or not the frequency detection start flag is set. If the flag is not set, the interruption process is ended with out any processing. However, since the frequency detection start flag is set in step 104 of FIG. 5, the routine proceeds to step 302 so as to count up (+1) the frequency detection timer until it is reset. Then, it is determined, in step 303, whether or not a predetermined time (500 ms in this embodiment) has passed. If the predetermined time has not passed, the interruption process is ended. On the other hand, if it has passed, the routine proceeds to step 304 so as to end the frequency detection and reset the frequency detection start flag.

Therefore, if 500 ms passes after setting the frequency detection start flag, the frequency detection is ended, and the determination in step 107 in the main routine of FIG. 5 becomes affirmative "YES". Therefore, the routine proceeds to a subroutine of step 108 where a frequency determination is performed.

In the subroutine of the frequency determination, as shown in FIG. 8, a count value of the number-of-times counter of zero cross interruption is first read in step 401. Thereafter, the power source frequency is determined in steps 402–406, based on the read count value.

That is, it is determined, in step 402, whether or not the count value falls within a range of 45 to 54. If the count value falls within the range of 45 to 54, the power source frequency is determined to be 50 Hz. Otherwise, the routine proceeds to step 404 so as to determine whether or not the count value falls within a range of 55 to 64. If the count value falls within the range of 55 to 64, the power source frequency is determined to be 60 Hz. Otherwise, it is determined that the frequency is unknown, and the result of the determination is stored in a memory.

Thereafter, the frequency detection start flag is again set in step 407. Then, the frequency detection timer is reset in step 408, and the number-of-times counter of zero cross interruption is cleared, and returns to the main routine of FIG. 5. Then, in step 109, as mentioned above, the result of the detection of the power supply frequency is checked. If the power source frequency is normally detected as 50 Hz or 60 Hz, the detected frequency is set again as the power source frequency in step 110. Then, the routine proceeds to a subroutine of step 111 where the fixation heater control is performed. On the other hand, if the frequency is unknown, this means that the detection is not normal, the routine proceeds to the subroutine of step 111 where the fixation heater control is performed with out any processing (that is, while the power source frequency is set to the tentatively determined frequency of 60 Hz).

In the subroutine of the fixation heater phase control, as shown in FIG. 9, the phase angle timer is first checked in step 501. Next, it is determined, in step 502, whether or not the count value of the phase angle timer matches the timer value set in the zero-cross interruption process. The determination of the count value of the phase angle timer is repeated until it matches the timer value of the phase angle timer. When the count value of the phase angle timer matches the timer value of the phase angle timer, the routine proceeds to step 503. In step 503, a trigger pulse is generated so as to turn on the triac 21 shown in FIG. 1 to be in a conducting state. The triac 21 maintains the conducting state until a subsequent zero-cross interruption occurs so as to continuously supply an electric power to the fixation heater 3. Therefore, the effective value of the voltage applied to the heater indicated by hatched portions in FIG. 4 is controlled by a conduction angle of the triac 21, that is, by the timer value of the phase angle timer.

Since the timer value of the phase angle timer is set based on the tentative frequency of 60 Hz so as to perform the phase control of the triac 21 before the poser source frequency is detected or is the power source frequency is not detected normally, the power supply control of the fixation heater 3 can be continuously performed. Even if the actual power source frequency is 50 Hz, the effective voltage is prevented from being increased against an intention to decrease the effective voltage such as abnormality shown in FIG. 4, and the effective voltage is slightly increased, which does not arise a problem in practice.

Additionally, as explained in the subroutine of the frequency determination process shown in FIG. 8, the frequency detection start flag is set again after the determination of the power source frequency is performed and the zero-cross interruption number-of-times counter is cleared so as to start again the frequency detection process. Therefore, even when the detection of the power source frequency is not completed for some reasons, the detection of the power source frequency is performed for every 500 ms. If the detection is normally performed and especially the detected frequency is 50 Hz, the phase control of the fixation heater is performed after setting the power source frequency to the detected frequency of 50 Hz. Thus, a more accurate phase control can be performed.

Although the description was made with respect to the case where there are tow kinds of frequencies as a power source frequency such as 50 Hz and 60 Hz in the above-mentioned embodiment, the power source frequency is not limited to 50 Hz or 60 Hz, and the present invention is applicable to a case where the power source frequency includes frequencies other than 50 Hz and 60 Hz or there are three or more kinds of frequencies as the power source frequency. Moreover, although the tentative frequency set before the power source frequency is detected is 60 Hz in the above-mentioned embodiment, the present invention is not limited to the tentative frequency of 60 Hz. An appropriate frequency, can be selected in accordance with kinds of frequencies of alternating currents to be supplied thereto. It is preferable to set the tentative frequency to a highest frequency from among frequencies of alternating currents which can be supplied thereto.

Moreover, the description was given of an example in which the present invention is applied to the fixation heater control apparatus of the fixation apparatus in the image forming apparatus using an electrophotography method such as a copy machine or a printer in the above-mentioned present, the present invention is not limited to such an apparatus and is applicable to a control apparatus of various kinds of heaters which require a soft start or a temperature control.

Figure 10:
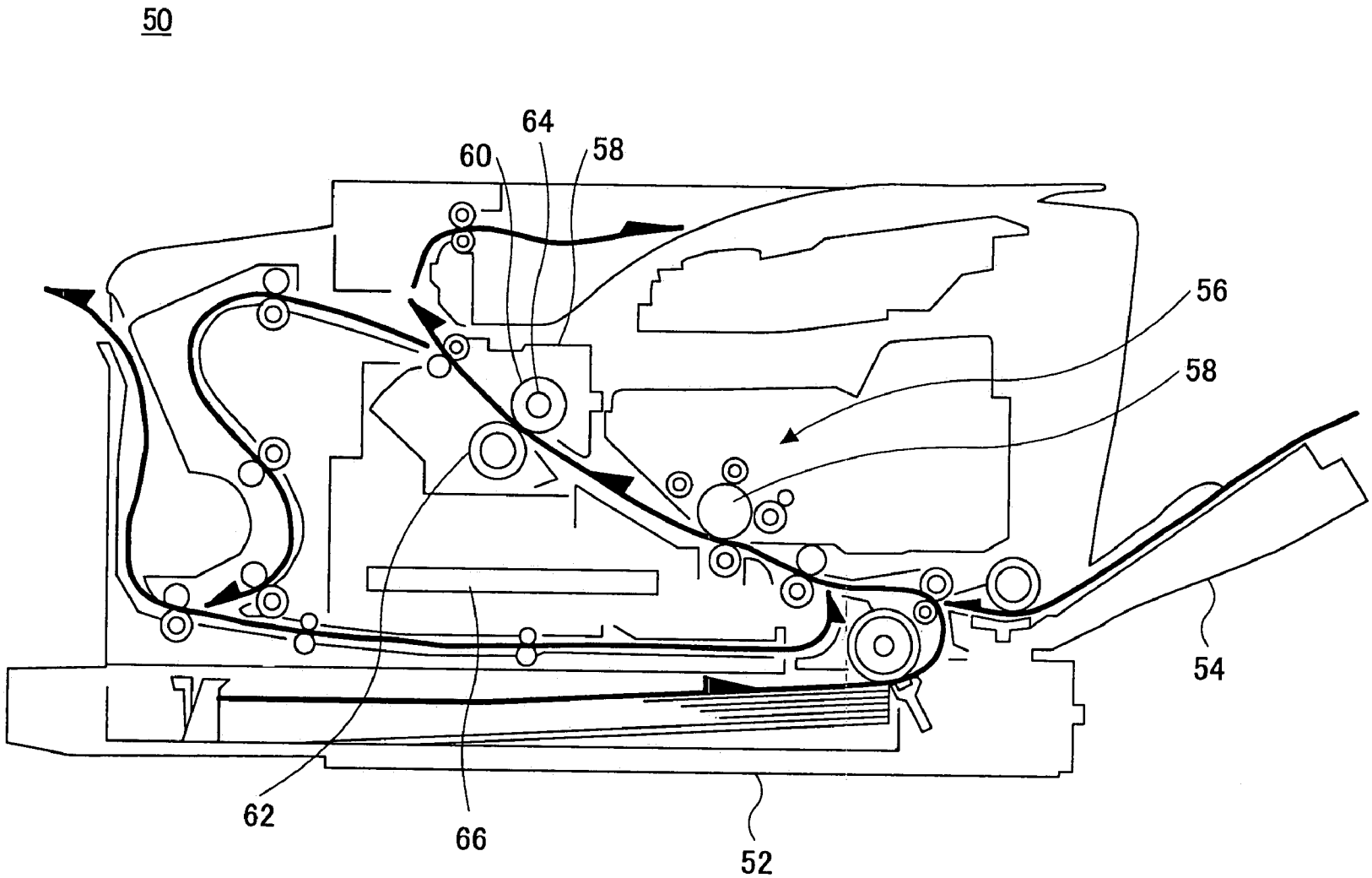
FIG. 10 is an illustration of a image forming apparatus equipped with a heater control apparatus according to the present invention.

FIG. 10 is an illustration showing a printer as an example of an image forming apparatus which is equipped with the heater control apparatus according to the above-mentioned embodiment. The printer 50 shown in FIG. 10 is an image forming apparatus which forms a toner image on a recording paper using an electrostatic photography method.

The recording paper supplied from a paper feed tray 52 or a multi-tray 54 is conveyed to a toner image forming part 56 by a series of conveyance rollers. In the toner image forming part 56, an electrostatic latent image is formed on a photosensitive drum 58. The electrostatic latent image is developed by toner and is turned to a toner image, and the toner image is transferred onto the recording paper.

The recording paper onto which the toner image is transferred is conveyed to a fixation unit 58. The fixation unit 58 has a fixation roller 60 and a pressurization roller 62. A heater 64 is incorporated into a core of the fixing roller 60 so as to heat the fixation roller 60 at a predetermined temperature. When the recording paper passes through between the fixation roller 60 and the pressurization roller 62, the toner image transferred onto the recording paper is fixed by being heated by the fixation roller 60 and also by being pressed by the pressurization roller 62. After the fixation of the toner image is completed, the recording paper is ejected from an upper side of a front side of the printer 50 by a series of rollers.

In the printer 50 having the above-mentioned structure, the heater control apparatus according to the present invention is used for the power supply control of the heater 64 incorporated into the fixation roller 60. A control part which controls the power supply to the heater 64 in accordance with the heater control method according to the present invention is provided in a control board 66 which is made of a printed circuit board provided in a main body of the printer 50. The heater 64 of the printer 50 requires a comparatively large electric power so as to rapidly heat the fixation roller 60. If a large electric power is supplied to the heater 64 when a power of the printer 50 is turned on, the power source voltage may fluctuate, which may influence electric equipments around the printer 50.

Thus, an electric power supplied to the heater 64 is controlled usually by a soft start method so as to gradually increase a voltage of the alternating current supplied to the heater 64. Since the soft start is performed based on a power source frequency, the power supply to the heater 64 is started after an actual power source frequency is detected in the printer 50 driven by an alternating current of 50 Hz or 60 Hz. Therefore, conventionally, an electric power is not supplied after the power switch of the printer 50 is turned on and until the power source frequency is detected. However, if the heater control apparatus according to the present invention is incorporated, an electric power can be supplied to the heater 64 based on the tentative frequency after the power switch of the printer 50 is turned on and until the power source frequency is detected. Therefore, the initial start-up time of the printer 50 can be reduced.

The present invention is not limited to the specifically disclosed embodiments, and variations and modifications may be made without departing from the scope of the present invention.

The present application is based on Japanese priority application No. 2002-286501 filed Sep. 30, 2003, the entire contents of which are hereby incorporated by reference.

What is claimed is:

1. A heater control apparatus configured and arranged to be operable by an alternating current having one of a plurality of frequencies, comprising:

a zero-cross point detector configured to detect a zero-cross point of a voltage waveform of the alternating current from an electric power source coupled to supply power to a heater and to generate a zero-cross signal based on the detected zero cross point;

a frequency detector configured to detect an actual frequency of the alternating current of the power source based upon the zero-cross signal; and a control part configured to control electric power being supplied to the heater, wherein, at a time of initially supplying power to the heater, the control part provides initial control based on a tentatively determined frequency of the alternating current corresponding to one of the plurality of frequencies until the frequency detector detects the actual frequency of the alternating current based upon the zero-cross signal to then control the electric power supplied to said heater based on the actual frequency of the alternating current detected by the frequency detector.

2. The heater control apparatus as claimed in claim 1, wherein said tentatively determined frequency is a highest frequency from among said plurality of frequencies.

3. The heater control apparatus as claimed in claim 1, wherein said plurality of frequencies are 50 Hz and 60 Hz, and said tentatively determined frequency is 60 Hz.

4. The heater control apparatus as claimed in claim 3, further comprising:

a switching circuit configured to switch supply of electric power to said heater from said power source on and off, wherein the control part is further configured to control the on and off switching of the switching circuit at a predetermined timing based on the zero-cross signal output from said zero-cross detector, said control part includes a setting circuit for setting a phase angle timer which determines a timing of turning on said switching circuit, at the time of initially supplying power to the heater, the electric power supplied to said heater is controlled by setting a timer value of said phase angle timer in accordance with the tentatively determined frequency, and the electric power supplied to said heater after the actual frequency of the alternating current is detected by said frequency detector is controlled by setting the timer value of said phase angle timer in accordance with the detected actual frequency.

5. The heater control apparatus as claimed in claim 4, wherein said control part is configured to continue the control of the electric power supplied to said heater by setting the timer value of said phase angle timer based on the tentatively determined frequency when the actual frequency detected by said frequency detector does not match any one of the plurality of frequencies.

6. The heater control apparatus as claimed in claim 5, wherein said control part is configured to store information in a nonvolatile memory indicating that the actual frequency detected by said frequency detector does not match any one of the plurality of frequencies and the electric power supply supplied to said heater is continued by setting the timer value of said phase angle timer based on the tentatively determined frequency.

7. An image forming apparatus comprising: a heater control apparatus for controlling a heater; and a fixation device equipped with said heater, wherein said heater control apparatus is configured and arranged to be operable by an alternating current having one of a plurality of frequencies, and includes, a zero-cross point detector configured to detect a zero-cross point of a voltage waveform of the alternating current from an electric power source coupled to supply power to a heater and to generate a zero-cross signal based on the detected zero cross point;

a frequency detector configured to detect an actual frequency of the alternating current of the power source based upon the zero-cross signal; and a control part configured to control electric power being supplied to the heater, wherein, at a time of initially supplying power to the heater, the control part provides initial control based on a tentatively determined frequency of the alternating current corresponding to one of the plurality of frequencies until the frequency detector detects the actual frequency of the alternating current based upon the zero-cross signal to then control the electric power supplied to said heater based on the actual frequency of the alternating current detected by the frequency detector.

8. The image forming apparatus as claimed in claim 7, wherein said tentatively determined frequency is a highest frequency from among said plurality of frequencies.

9. The image forming apparatus as claimed in claim 7, wherein said plurality of frequencies are 50 Hz and 60 Hz and said tentatively determined frequency is 60 Hz.

10. The image forming apparatus as claimed in claim 9, further comprising:

a switching circuit configured to switch supply of electric power to said heater from said power source on and off, wherein the control part is further configured to control the on and off switching of the switching circuit at a predetermined timing based on the zero-cross signal output from said zero-cross detector, said control part includes a setting circuit for setting a phase angle timer which determines a timing of turning on said switching circuit, at the time of initially supplying power to the heater, the electric power supplied to said heater is controlled by setting a timer value of said phase angle timer in accordance with the tentatively determined frequency, and the electric power supplied to said heater after the actual frequency of the alternating current is detected by said frequency detector is controlled by setting the timer value of said phase angle timer in accordance with the detected actual frequency.

11. The image forming apparatus as claimed in claim 10, wherein said control part is configured to continue the control of the electric power supplied to said heater by setting the timer value of said phase angle timer based on the tentatively determined frequency when the actual frequency detected by said frequency detector does not match any one of the plurality of frequencies.

12. The image forming apparatus as claimed in claim 11, wherein said control part is configured to store information in a nonvolatile memory indicating that the actual frequency detected by said frequency detector does not match any one of the plurality of frequencies and the electric power supply supplied to said heater is continued by setting the timer value of said phase angle timer based on the tentatively determined frequency.

13. A heater control method of a heater configured and arranged to be operable by an alternating current having one of a plurality of frequencies, the heater control method comprising the steps of:

detecting a zero-cross point of a voltage waveform of the alternating current to be supplied to a heater so as to generate a zero-cross signal;

detecting an actual frequency of the alternating current being supplied to the heater from the power supply based upon the zero-cross signal; and controlling the electric power supply to the heater, wherein the controlling step includes sub-steps of, tentatively determining the frequency of the alternating current when power is initially supplied to the heater and before the actual frequency is detected in the frequency detecting step;

initially controlling the electric power supply to said heater based on the tentatively determined frequency before the actual frequency is detected in the frequency detecting step; and controlling the electric power supply to said heater after the frequency of the alternating current is detected in said detecting step based on the detected actual frequency.

14. The heater control method as claimed in claim 13, further including selecting a highest frequency from among said plurality of frequencies as said tentatively determined frequency in the step of tentatively determining the frequency.

15. The heater control method as claimed in claim 14, wherein said plurality of frequencies are 50 Hz and 60 Hz, and, selecting 60 Hz as said tentatively determined frequency.

16. The heater control method as claimed in claim 15, wherein the step of initially controlling the electric power supply to said heater based on the tentatively determined frequency before the actual frequency is detected in the frequency detecting step includes setting a timer value of a phase angle timer in accordance with the tentatively determined frequency, the phase angle timer determining a timing of turning on a switching circuit; and the step of controlling the electric power supply to said heater after the frequency of the alternating current is detected in said detecting step based on the detected actual frequency by setting the timer value of said phase angle timer in accordance with the detected actual frequency.

17. The heater control method as claimed in claim 16, further comprising a step of continuing the control of the electric power supply to said heater by setting the timer value of said phase angle timer based on the tentatively determined frequency when the detected actual frequency does not match any one of the plurality of frequencies.

18. The heater control method as claimed in claim 17, further comprising a step of storing information in a non-volatile memory, the information indicating that the frequency detected by said frequency detection circuit does not match any one of the plurality of frequencies and the electric power supply to said heater is continued by setting the timer value of said phase angle timer based on the tentatively determined frequency.

19. A heater apparatus configured and arranged to be operable by an alternating current having one of a plurality of frequencies, comprising:

means for detecting zero-cross points of a voltage waveform of the alternating current from an electric power source coupled to supply electric power to a heater and for generating a zero-cross signal based on said detected zero-cross points;

frequency detecting means for detecting the actual frequency of the alternating current from the electric power source based upon the zero-cross signal; and means for controlling electric power supplied to the heater, wherein, the means for controlling provides initial control of the electric power supplied to the heater based on a tentatively determined frequency of the alternating current corresponding to one of the plurality of frequencies before an actual frequency is detected by the frequency detecting means and the means for controlling controls the electric power supplied to the heater based on the actual frequency detected by the frequency detecting means after the actual frequency is detected by the frequency detecting means.

20. The heater control apparatus as claimed in claim 19, wherein said plurality of frequencies are 50 Hz and 60 Hz, and said tentatively determined frequency is 60 Hz.

* * * * *